US012031432B2

(12) United States Patent
Pollock et al.

(10) Patent No.: US 12,031,432 B2
(45) Date of Patent: Jul. 9, 2024

(54) EXCAVATION APPARATUS WITH SUPPORTING LINKAGE

(71) Applicant: Utilicor Technologies Inc., Toronto (CA)

(72) Inventors: Edward Marshall Pollock, Toronto (CA); Andrew Leslie Pollock, Toronto (CA); Jeffrey Haas, Toronto (CA)

(73) Assignee: UTILICOR TECHNOLOGIES INC., Toronto (CA)

( * ) Notice: Subject to any disclaimer, the term of this patent is extended or adjusted under 35 U.S.C. 154(b) by 346 days.

(21) Appl. No.: 17/335,222

(22) Filed: Jun. 1, 2021

(65) Prior Publication Data

US 2021/0372201 A1 Dec. 2, 2021

Related U.S. Application Data

(60) Provisional application No. 62/704,873, filed on Jun. 1, 2020.

(51) Int. Cl.

| | |
|---|---|
| ***E21B 7/02*** | (2006.01) |
| ***E21B 10/02*** | (2006.01) |
| *E01C 23/09* | (2006.01) |
| *E21B 25/00* | (2006.01) |

(52) U.S. Cl.

CPC ..... *E21B 7/027* (2013.01); *E21B 10/02* (2013.01); *E01C 23/094* (2013.01); *E21B 7/024* (2013.01); *E21B 25/00* (2013.01)

(58) Field of Classification Search

CPC ..... E21B 7/027; E21B 10/02; E21B 7/024; E21B 25/00; E21B 7/02; E01C 23/094

USPC ..... 173/28, 184–189

See application file for complete search history.

(56) References Cited

U.S. PATENT DOCUMENTS

| | | | | |
|---|---|---|---|---|
| 2,754,085 A * | 7/1956 | Sewell | E21B 7/024 175/323 |
| 3,919,816 A * | 11/1975 | Ranft | E21B 15/04 173/195 |
| 3,977,547 A * | 8/1976 | Holopainen | E02F 3/306 414/687 |

(Continued)

FOREIGN PATENT DOCUMENTS

| | | |
|---|---|---|
| EP | 0392672 A1 * | 10/1990 |
| WO | WO-2022103981 A1 * | 5/2022 |

OTHER PUBLICATIONS

Utilicor Technologies Inc., MD-300 Core Mobility.

(Continued)

*Primary Examiner* — Robert F Long

(74) *Attorney, Agent, or Firm* — Bereskin & Parr LLP/S.E.N.C.R.L., s.r.l.

(57) ABSTRACT

An excavation apparatus includes a supporting linkage mountable to a vehicle, and a rotary spindle operable to drive a coring element about a cutting axis. The supporting linkage supports the rotary spindle and is operable to displace the rotary spindle relative to a ground surface. The supporting linkage can lower the rotary spindle to a deployed position and raise the rotary spindle to a stored position. The cutting axis can be maintained in a vertical direction in the deployed and stored positions. The rotary spindle can move relative to the supporting linkage about a hinge axis. The hinge axis can be generally parallel to the vertical direction.

16 Claims, 17 Drawing Sheets

(56) References Cited

U.S. PATENT DOCUMENTS 4,047,593 A * 9/1977 Dammeyer ..... B66F 11/044 182/2.8
4,061,194 A * 12/1977 McCanse ..... E02F 3/844 172/260.5
4,071,095 A * 1/1978 Herron ..... E21B 7/025 173/152
4,296,509 A * 10/1981 Simmons ..... A61G 7/1015 5/85.1
4,456,093 A * 6/1984 Finley ..... B66F 11/046 182/2.11
4,502,269 A * 3/1985 Cartner ..... A01D 34/866 56/15.5
4,869,002 A * 9/1989 Glenn ..... E02F 5/00 37/403
5,014,863 A * 5/1991 Vlaanderen ..... B66C 23/42 212/304
5,158,146 A * 10/1992 Fuller ..... E21B 7/026 175/203
5,213,169 A * 5/1993 Heller ..... E21B 21/12 175/215
5,232,268 A * 8/1993 Dengler ..... E21D 9/006 173/184
5,273,124 A * 12/1993 Lloyd ..... E21B 3/022 175/122
5,290,014 A * 3/1994 Fergison, Jr. ..... B62D 43/045 242/396.2
5,356,214 A * 10/1994 Styles ..... B01F 27/806 366/285
5,513,901 A * 5/1996 Smith ..... B60P 1/34 298/22 J
5,709,276 A * 1/1998 Lee ..... E21B 7/046 175/122
5,954,143 A * 9/1999 McCabe ..... E21B 7/025 173/171
5,984,050 A * 11/1999 Ronald ..... B66F 9/08 187/234
6,174,104 B1 * 1/2001 Fields ..... E01C 23/08 404/93
6,269,913 B1 * 8/2001 Kollmannsberger ..... B66F 9/0755 187/394
6,315,059 B1 * 11/2001 Geldean ..... E21B 7/028 173/147
6,460,652 B1 * 10/2002 Piipponen ..... E21B 7/026 182/2.11
6,715,563 B2 * 4/2004 Hubbard ..... E21B 7/24 173/184
7,354,237 B2 * 4/2008 Frey ..... E02F 3/38 414/917
7,757,780 B2 7/2010 Pollock et al.
7,828,506 B1 * 11/2010 Young ..... B66F 3/00 254/342
8,327,950 B2 12/2012 Pollock et al.
8,418,783 B2 * 4/2013 Saf ..... E21B 7/025 175/122
9,856,698 B2 1/2018 Pollock et al.
10,041,301 B2 * 8/2018 Jones ..... E21B 7/027
2004/0168814 A1 * 9/2004 Stewart ..... B25D 17/00 173/184
2004/0178004 A1 * 9/2004 MacDonald ..... E21B 7/025 175/203
2006/0213676 A1 * 9/2006 Jinnings ..... E02D 7/10 173/184
2007/0059135 A1 * 3/2007 Mizner ..... B60P 1/4442 414/462
2008/0143072 A1 * 6/2008 Parker ..... E06C 1/005 280/166
2009/0121537 A1 * 5/2009 Orgard ..... E21C 37/22 299/69
2010/0170747 A1 * 7/2010 Crook ..... B66F 11/046 182/2.2
2010/0215449 A1 * 8/2010 Kern ..... B23B 39/161 408/1 R
2011/0042142 A1 * 2/2011 Edmonds ..... E21B 15/04 173/39
2011/0100659 A1 * 5/2011 Murate ..... E02D 7/16 173/104
2011/0240321 A1 * 10/2011 Palmlund ..... E02D 13/00 173/90
2012/0031679 A1 * 2/2012 Pollock ..... E21B 7/028 175/195
2012/0247836 A1 * 10/2012 Wilson ..... E21D 20/003 175/203
2013/0152513 A1 * 6/2013 Havens ..... B65B 25/14 53/469
2013/0233625 A1 * 9/2013 Robinson ..... E21B 7/027 175/203
2013/0255985 A1 * 10/2013 Zakuskin ..... B25D 9/10 173/209
2014/0037415 A1 * 2/2014 Zuritis ..... E02F 3/42 29/428
2014/0102740 A1 * 4/2014 Jagdale ..... E02F 3/966 173/114
2014/0124605 A1 * 5/2014 Deze ..... A01G 17/02 56/375
2014/0271076 A1 * 9/2014 Perron ..... B66F 11/046 414/719
2014/0290102 A1 * 10/2014 O'Donnell ..... E02F 3/435 74/471 R
2015/0008039 A1 * 1/2015 Wijning ..... E04B 1/34336 175/52
2015/0021095 A1 * 1/2015 Wijning ..... E04H 12/345 175/57
2016/0138299 A1 * 5/2016 Powers, III ..... E04H 17/263 173/184
2016/0221170 A1 * 8/2016 Moore ..... B25D 9/145
2018/0119492 A1 * 5/2018 Nelson ..... E21B 7/025
2018/0142519 A1 * 5/2018 Jones ..... E21B 10/44
2018/0326507 A1 * 11/2018 Halvorsen ..... B23B 39/14
2018/0363376 A1 * 12/2018 Jones ..... B60R 11/06
2019/0169009 A1 * 6/2019 Gales ..... B66F 9/0655
2019/0300295 A1 * 10/2019 Malivoir ..... B65G 47/904
2021/0372201 A1 * 12/2021 Pollock ..... E21B 10/02
2022/0325582 A1 * 10/2022 Stephens ..... E21B 10/44
2023/0022559 A1 * 1/2023 King ..... E21B 15/04

OTHER PUBLICATIONS

Tracto-Technik Gmbh & Co. KG, The Keyhole-Technology: Efficient new installations and rehabilitation of house connections from small construction pits.
8293 Kor-It K-1700 Flexible Position Receiver Mounted Drilling System.

* cited by examiner

EXCAVATION APPARATUS WITH SUPPORTING LINKAGE

CROSS-REFERENCE TO RELATED APPLICATION

This application claims priority to U.S. Provisional Application No. 62/704,873 filed on Jun. 1, 2020, the entire contents of which are hereby incorporated herein by reference.

FIELD

The present disclosure relates to excavating apparatuses for coring or drilling concrete or paved ground surfaces.

BACKGROUND

The following paragraphs are not an admission that anything discussed in them is prior art or part of the knowledge of persons skilled in the art.

U.S. Pat. No. 7,757,780 discloses an excavation apparatus that includes a support structure mountable to a truck bed, the support structure defining a longitudinal direction extending front-to-back of the truck bed, and a lateral direction extending side-to-side of the truck bed. The apparatus further includes a rotary spindle pivotably supported by the support structure at a first pivot joint defining a generally horizontal first pivot axis, the spindle extending lengthwise along a spindle axis and rotatable thereabout for driving a cutting head; the spindle pivotable about the horizontal first pivot axis between a stowed position wherein the spindle axis is generally horizontal, and a deployed position wherein the spindle axis is generally vertical. The support structure includes a first adjustment device for adjusting the position of the spindle in the longitudinal direction when deployed, and a second adjustment device for adjusting the position of the spindle in the lateral direction when deployed.

U.S. Pat. No. 8,327,950 discloses an excavation apparatus that includes a base structure mountable to a vehicle, and a first supporting member pivotally coupled to the base structure. The first supporting member is pivotable about a pivot axis that is generally parallel to a lateral direction between a retracted position and an advanced position. A second supporting member is rotatably coupled to the first supporting member. A rotary spindle is supported by the second supporting member and extends lengthwise along a cutting axis and is rotatable thereabout for driving a cutting element. When the first supporting member is in the advanced position, the second supporting member is rotatable about a rotation axis that is generally parallel to a longitudinal direction between a stowed position in which the cutting axis is generally parallel to the lateral direction and a deployed position in which the cutting axis is generally parallel to a vertical direction.

U.S. Pat. No. 9,856,698 discloses a self-propelled, towable coring apparatus that includes a base structure having at least one primary wheel. A rotary spindle drives a coring element. A support mechanism supports the rotary spindle and displaces the rotary spindle upwardly and downwardly relative to a ground surface. At least one engine is supported by the base structure and provides power to the at least one primary wheel to propel the apparatus, and to the rotary spindle to drive the coring element. A tow member is connected to the base structure for trailering the apparatus by a towing vehicle.

INTRODUCTION

The following paragraphs are intended to introduce the reader to the more detailed description that follows and not to define or limit the claimed subject matter.

According to an aspect of the present disclosure, an excavation apparatus can include: a supporting linkage mountable to a vehicle; and a rotary spindle operable to drive a coring element about a cutting axis. The supporting linkage can support the rotary spindle and can be operable to displace the rotary spindle relative to a ground surface.

The supporting linkage can be configured to lower the rotary spindle relative to a ground surface to a deployed position, and raise the rotary spindle relative to the ground surface to a stored position. The cutting axis can be maintained in a generally vertical direction in the deployed and stored positions. The supporting linkage can include an inner bracket, an outer bracket that is spaced apart from the inner bracket, at least one upper bar that is pivotably connected to the inner and outer brackets, and at least one lower bar that is pivotably connected to the inner and outer brackets. The supporting linkage can include an actuator for moving the supporting linkage between the deployed and stored positions. The actuator can include a bottom end pivotably connected to the inner bracket, and an upper end pivotably connected to the at least one upper bar. Extension of the actuator can cause the supporting linkage to move from the deployed position to the stored position, and retraction of the actuator can cause the supporting linkage to move from the stored position to the deployed position. At least one of the upper and lower bars can include an actuator for adjusting an angle of the cutting axis.

The apparatus can include a vertical supporting member that couples the rotary spindle to the supporting linkage. The rotary spindle can be configured to translate along the vertical supporting member. The apparatus can include a platform slidably coupled to the vertical supporting member, and the rotary spindle can be mounted to the platform. The apparatus can include a motor for driving the rotary spindle, and the motor is mounted to the platform. The apparatus can include a linear actuator configured to move the platform relative to the vertical supporting member.

The rotary spindle can be configured to move relative to the supporting linkage about a hinge axis. The hinge axis can be generally parallel to a vertical direction. The apparatus can include a hinge pin that connects an outer bracket of the supporting linkage to a vertical supporting member that is coupled to the rotary spindle.

The apparatus can include a horizontal supporting member for coupling the supporting linkage to the vehicle. The supporting linkage can be configured to translate along the horizontal supporting member. The apparatus can include a linear actuator configured to move the supporting linkage relative to the horizontal supporting member.

According to an aspect of the present disclosure, the apparatus can be combined with the vehicle. The supporting linkage can be mounted to a rear of the vehicle, the rotary spindle can be configured to move relative to the supporting linkage about a hinge axis to a cleared position, the hinge axis being generally parallel to a vertical direction, and, in the cleared position, the rotary spindle can be arranged outside of a lateral extent of the rear of the vehicle.

According to an aspect of the present disclosure, an excavation apparatus can include: a supporting linkage mountable to a vehicle; a vertical supporting member connected to the supporting linkage; and a rotary spindle coupled to the vertical supporting member and operable to drive a coring element about a cutting axis. The vertical supporting member can be configured to move relative to the supporting linkage about a hinge axis that is generally parallel to a vertical direction.

According to an aspect of the present disclosure, an excavation apparatus can include: a supporting linkage including an inner bracket, an outer bracket that is spaced apart from the inner bracket, at least one upper bar that is pivotably connected to the inner and outer brackets, and at least one lower bar that is pivotably connected to the inner and outer brackets; a vertical supporting member connected to the outer bracket of the supporting linkage; and a rotary spindle coupled to the vertical supporting member and operable to drive a coring element about a cutting axis. The inner bracket of the supporting linkage can be mountable to a vehicle. The supporting linkage can be configured to lower the vertical supporting member relative to a ground surface to a deployed position, and raise the vertical supporting member relative to the ground surface to a stored position. The vertical supporting member can be configured to move relative to the supporting linkage about a hinge axis that is generally parallel to a vertical direction.

Other aspects and features of the teachings disclosed herein will become apparent, to those ordinarily skilled in the art, upon review of the following description of the specific examples of the present disclosure.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Various apparatuses or methods are described below to provide an example of an embodiment of each claimed invention. No example described below limits any claimed invention and any claimed invention may cover apparatuses and methods that differ from those described below. The claimed inventions are not limited to apparatuses and methods having all of the features of any one apparatus or method described below or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, and the applicant(s), inventor(s) and/or owner(s) do not intend to abandon, disclaim or dedicate to the public any such invention by its disclosure in this document.

Figure 1:
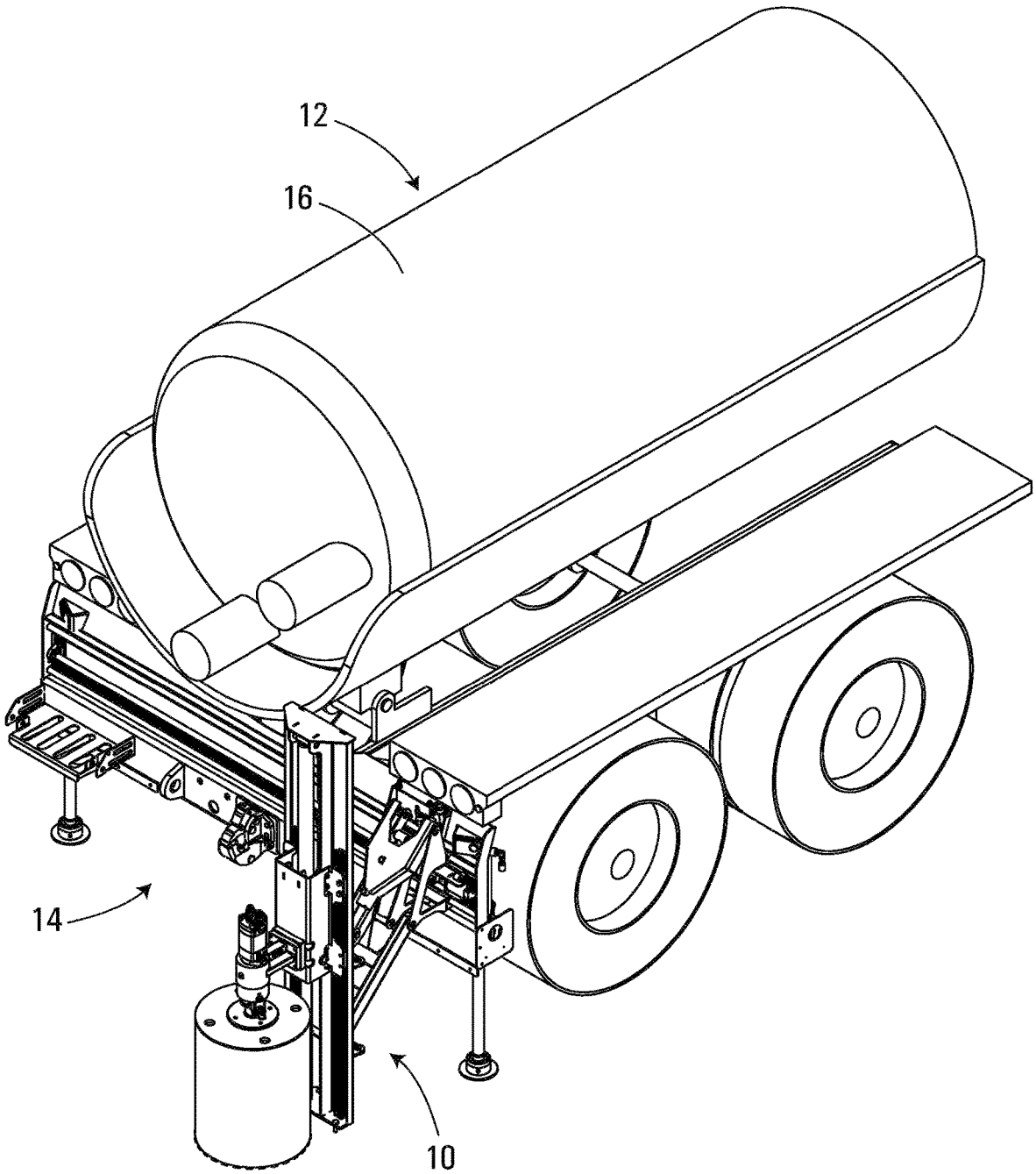
FIG. 1 is a rear perspective view of an example of an excavation apparatus in combination with a vehicle, shown with the apparatus in a deployed position.

Referring to FIG. 1, an example of an excavation apparatus is shown generally at 10. The apparatus 10 can be installed to a vehicle 12. As illustrated, the vehicle 12 can be a hydro excavation truck. In the example illustrated, the apparatus 10 is mounted at a rear 14 of the vehicle 12 and is shown in a deployed position. As described herein, the apparatus 10, when deployed, can travel from side-to-side across the rear 14 of the vehicle 12, and, when not in use, can be stored in an upright position on the curb side of the vehicle 12. As described herein, the apparatus 10 can be further moved clear of the rear 14 of the vehicle 12, which can allow the tank 16 to be elevated to dump its spoil.

Figure 2:
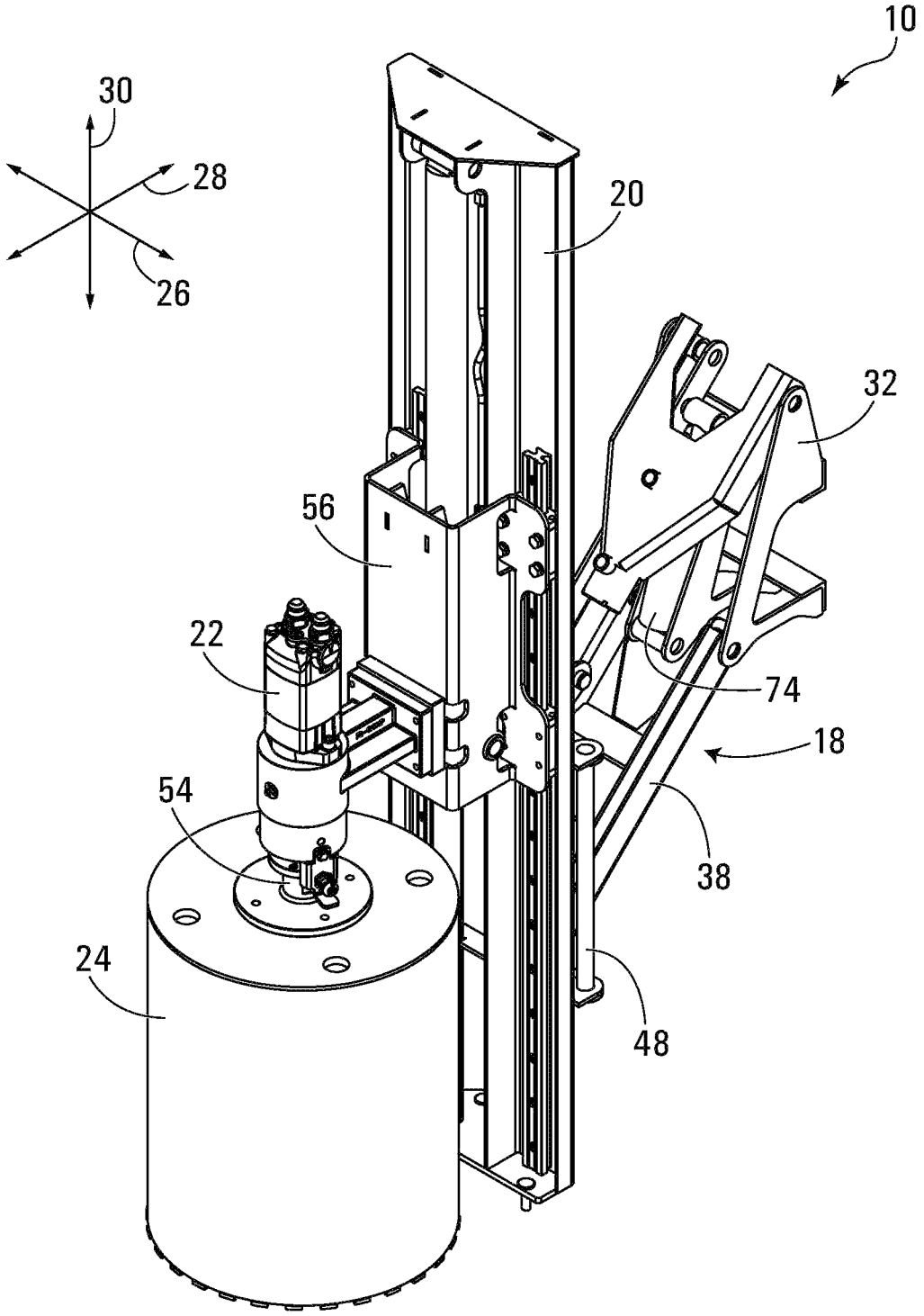
FIGS. 2, 3 and 4 are rear perspective, front perspective and side views, respectively, of the apparatus in the deployed position.
Figure 3:
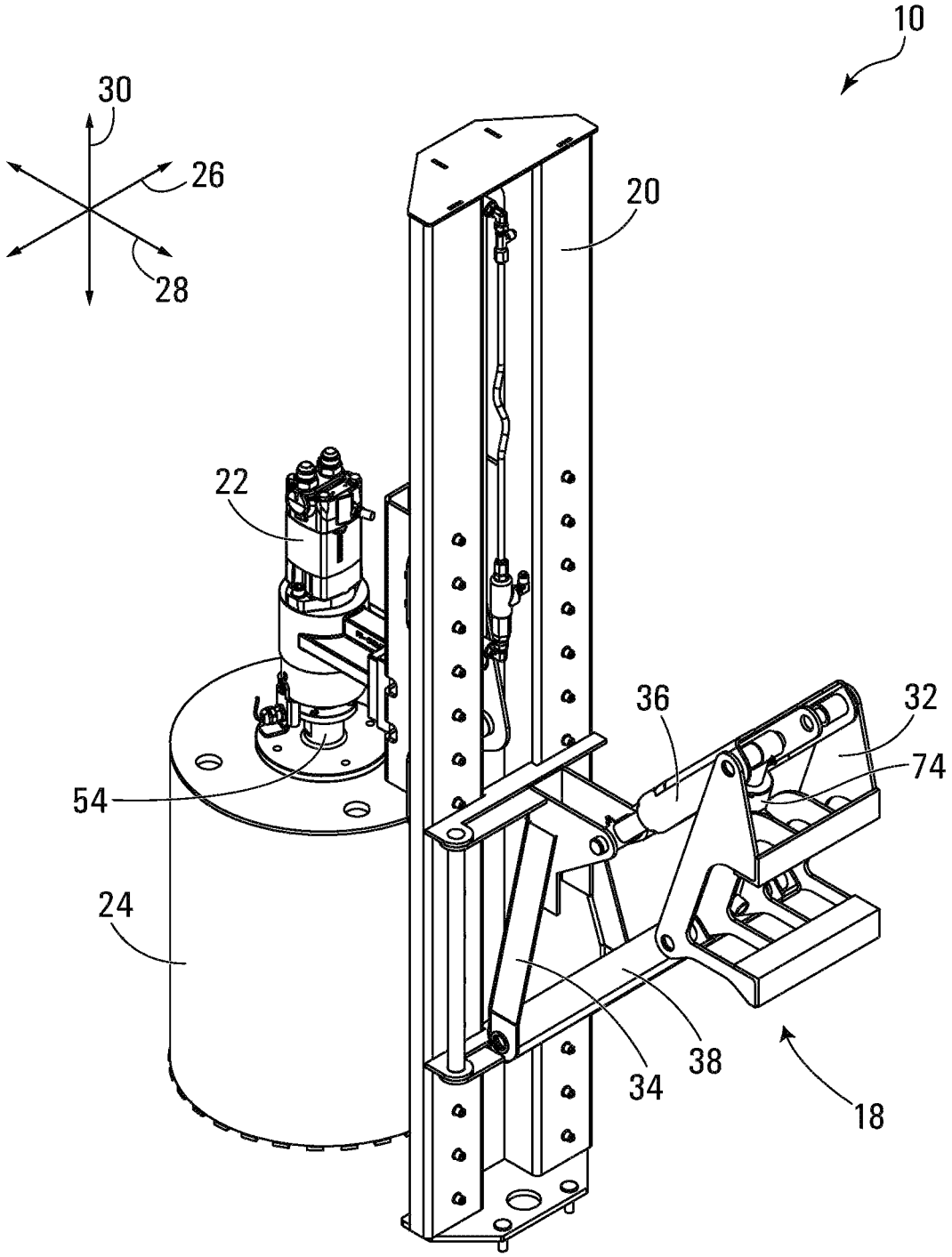
Figure 4:
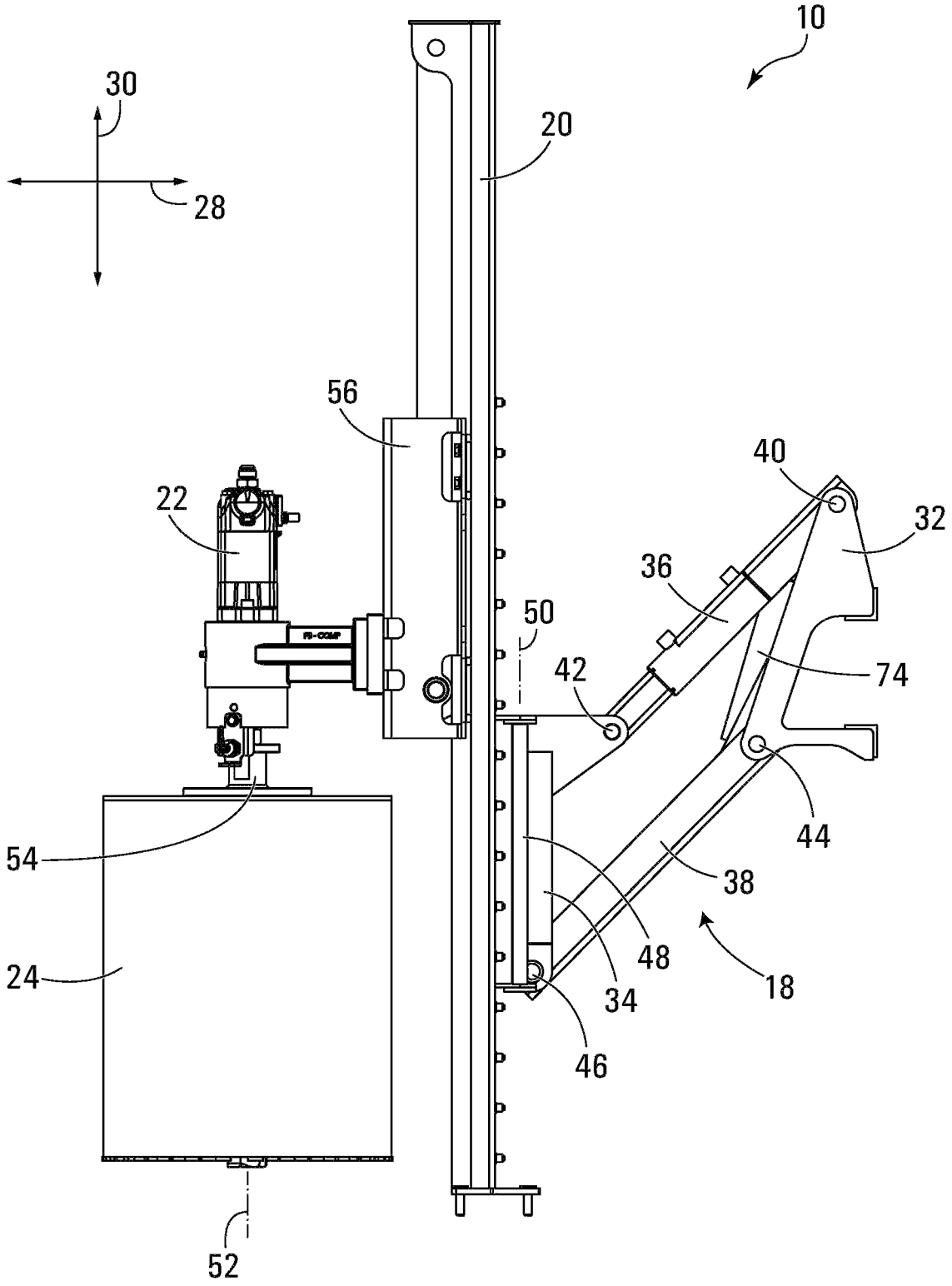

Referring to FIGS. 2, 3 and 4, the apparatus 10 includes an actuatable supporting linkage 18 and a vertical supporting member 20. In the example illustrated, the apparatus 10 includes a motor 22 coupled to and supported by the vertical supporting member 20. The motor 22 is configured to rotatably drive a cutting element 24. The cutting element 24 can be a coring or drilling bit, of various sizes and configurations. When the apparatus 10 is in the deployed position, the motor 22 and the cutting element 24 can be used to perform a cutting operation to penetrate a ground surface.

In FIGS. 2 and 3, the apparatus 10 is shown relative to a lateral direction 26, a longitudinal direction 28 and a vertical direction 30. In FIG. 4, the apparatus 10 is shown relative to the longitudinal direction 28 and the vertical direction 30. The lateral direction 26, the longitudinal direction 28 and the vertical direction 30 can be mutually orthogonal.

In the example illustrated, the supporting linkage 18 includes an inner bracket 32 and an outer bracket 34 that is spaced apart from the inner bracket 32. The inner bracket 32 can be used to attach or mount the apparatus 10 to the vehicle 12 (FIG. 1).

In the example illustrated, the supporting linkage 18 further includes an upper bar 36 and a pair of lower bars 38. The bars 36, 38 extend between the brackets 32, 34. The upper bar 36 is connected to the inner bracket 32 by a pair of pivot joints 40, and is connected to the outer bracket 34 by a pivot joint 42. The lower bars 38 are connected to the inner bracket 32 by a pair of pivot joints 44, and are connected to the outer bracket 34 by a pair of pivot joints 44. Thus, the supporting linkage 18 takes the form of a four-bar linkage, with each of the joints 40, 42, 44, 46 permitting movement about pivot axes that are generally parallel to the lateral direction 26.

In the example illustrated, a hinge pin 48 connects the outer bracket 34 of the supporting linkage 18 to the vertical supporting member 20. The hinge pin 48 permits movement of the vertical supporting member 20 relative to the supporting linkage 18 about a hinge axis 50 (FIG. 4) that is generally parallel to the vertical direction 30.

The motor 22 is configured to rotatably drive the cutting element 24 about a cutting axis 52 (FIG. 4). In the example illustrated, a rotary spindle 54 connects the motor 22 and the cutting element 24 and transfers rotational energy and thrust load therebetween. The rotary spindle 54 is rotatable about the cutting axis 52 for driving the cutting element 24.

In the example illustrated, the vertical supporting member 20 is elongate and extends lengthwise generally parallel to the vertical direction 30. The apparatus 10 can be configured so that the rotary spindle 54 translates relative to the vertical supporting member 20 to adjust the positioning of the cutting element 24 in the vertical direction 30.

In the example illustrated, the upper bar 36 includes an actuator for controlling the length of the upper bar 36. By adjusting the length of the upper bar 36, the apparatus 10 can be leveled as desired so that the cutting axis can be maintained generally perpendicular to the ground surface. As shown, the upper bar 36 can include a hydraulic cylinder. In other examples, the actuator can be, for example but not limited to, a pneumatic cylinder or an electric actuator.

In the example illustrated, the apparatus 10 includes a platform 56. The motor 22, the rotary spindle 54 and the cutting element 24 are mounted to the platform 56, and the platform 56 is slidably coupled to the vertical supporting member 20. Displacement of the platform 56 relative to the vertical supporting member 20 provides a range of motion of the rotary spindle 54 and the cutting element 24 in the vertical direction 30, i.e. parallel to the cutting axis 52 and generally perpendicular to the ground surface.

Figure 5:
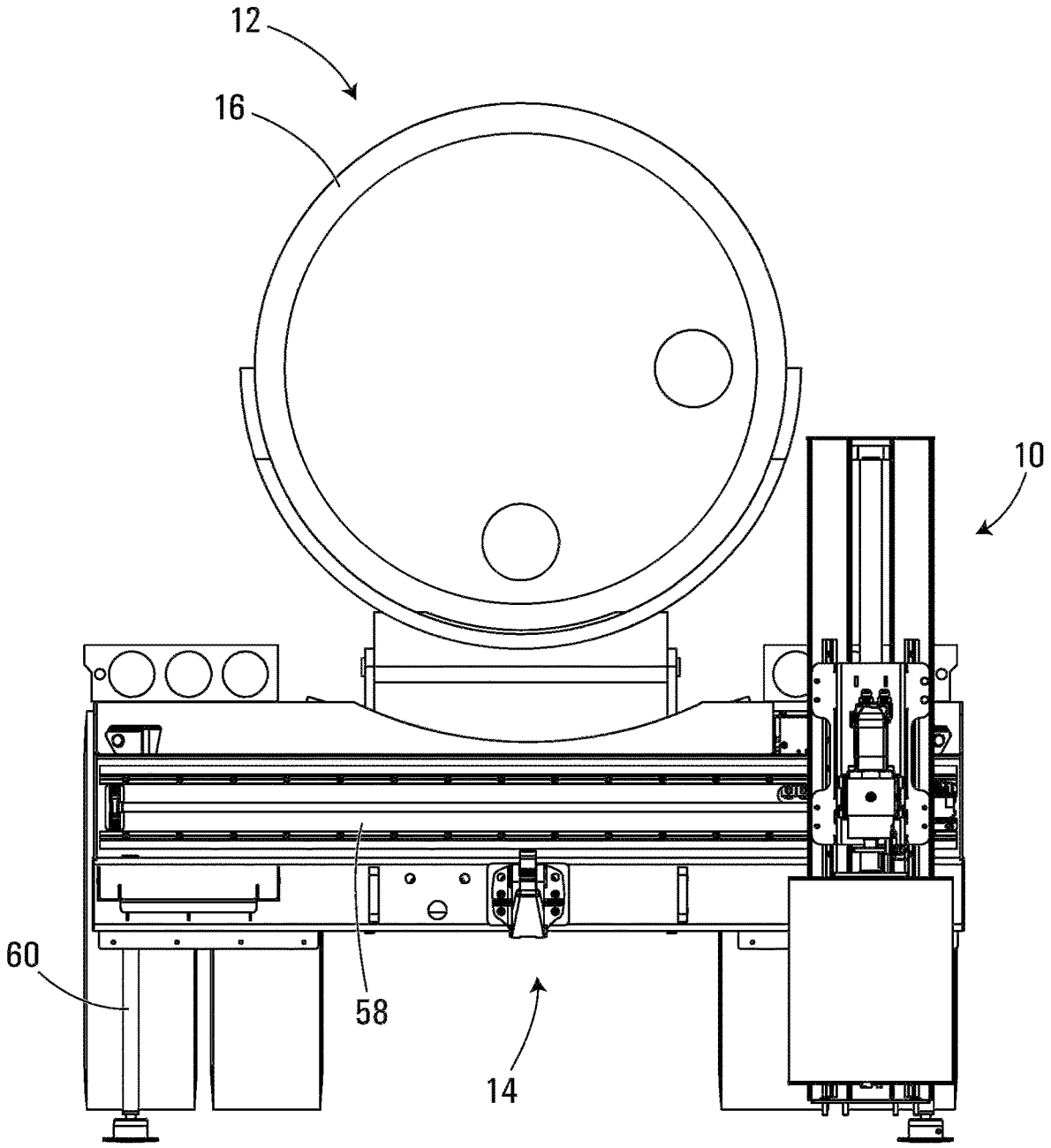
FIGS. 5, 6 and 7 are rear, side and top views, respectively, of the apparatus and the vehicle, shown with the apparatus in the deployed position.
Figure 6:
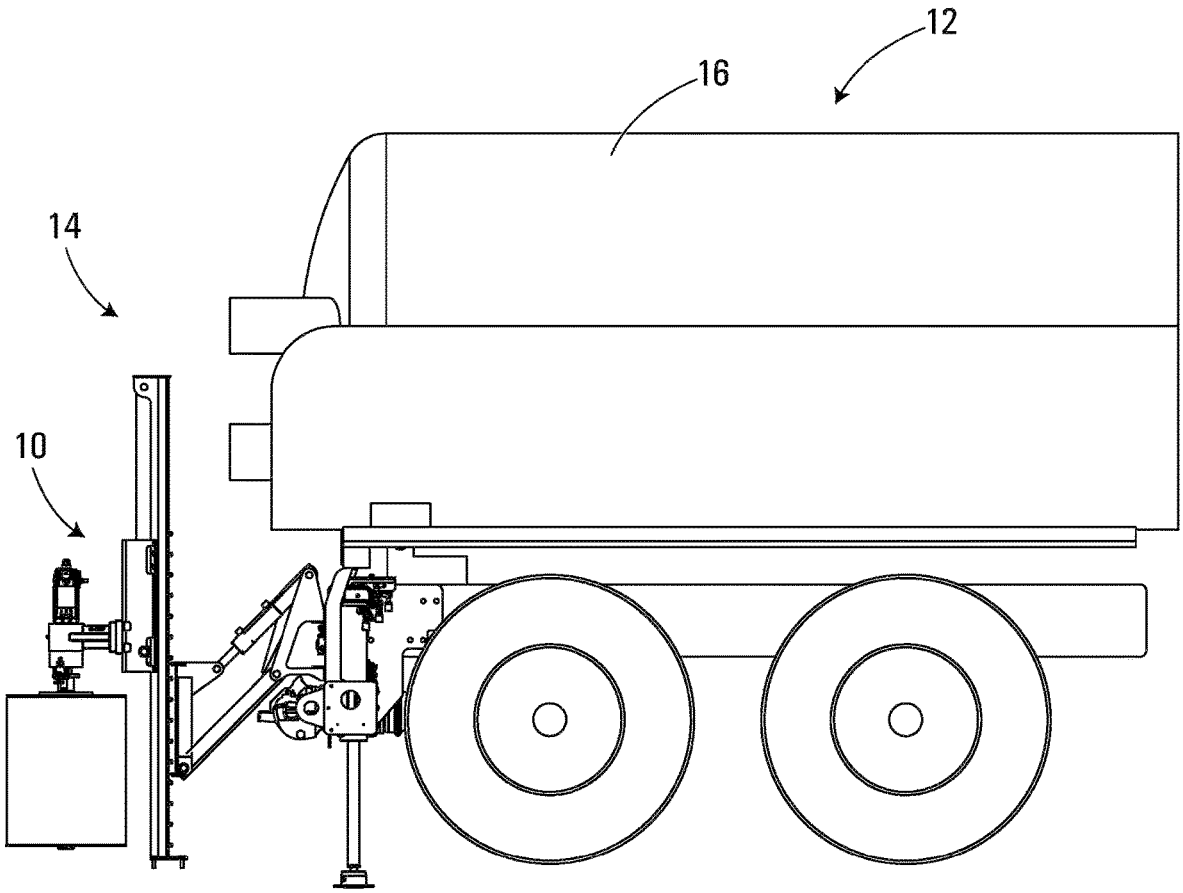
Figure 7:
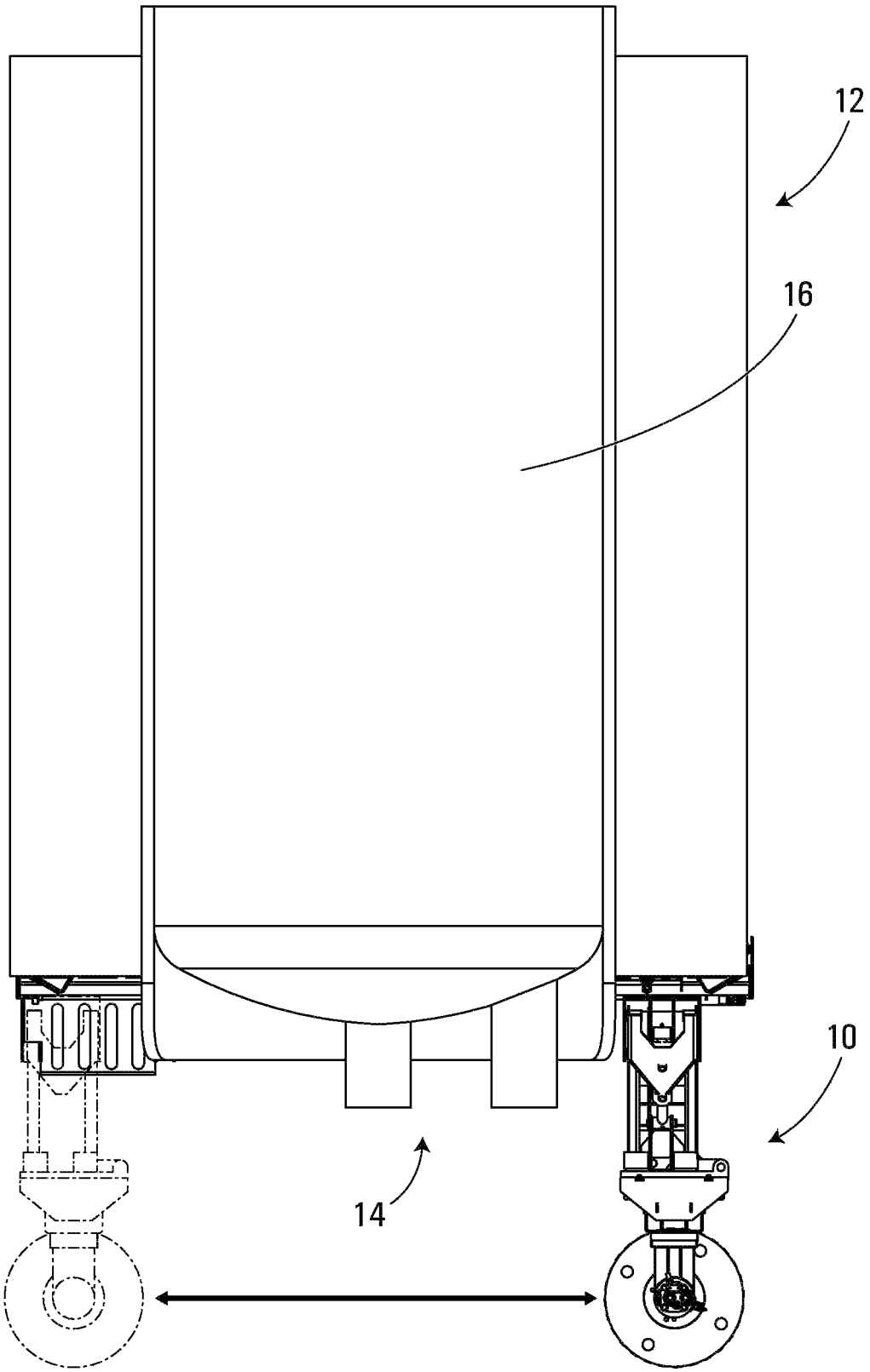

Referring to FIGS. 5, 6, and 7, the apparatus 10 is coupled to the vehicle 12 by a horizontal supporting member 58. In the example illustrated, the horizontal supporting member 58 has a linear extent that generally corresponds with a width of the rear 14 of the vehicle 12. The horizontal supporting member 58 can be incorporated into a unit that replaces the original rear bumper assembly of the vehicle 12. The supporting linkage 18 can be configured to translate relative to the horizontal supporting member 58 to adjust the positioning of the cutting axis 52 in the lateral direction 26 (FIGS. 2 and 3). An outer profile of the horizontal supporting member 58 can define a track, and an inner profile of the inner bracket 32 can slidably engage the track. A leadscrew mechanism or other linear actuator can be used with the horizontal supporting member 58 to move the apparatus 10 linearly across the width of the rear 14 of the vehicle 12 (FIG. 7).

In the example illustrated, stabilizers 60 are disposed generally at respective opposing ends of the horizontal supporting member 58. Each of the stabilizers 60 is operable to move between a stabilizing position and a raised position. In the stabilizing position, each of the stabilizers 60 engages the ground surface to absorb or counteract forces created during the cutting operation. In the raised position, each of the stabilizers 60 is disengaged from the ground surface, permitting the vehicle 12 to be driven.

Referring again to FIG. 4, the supporting linkage 18 supports the vertical supporting member 20, the motor 22, the cutting element 24, the rotary spindle 54 and the platform 56, and is operable to displace this assembly upwardly and downwardly relative to the ground surface. In the example illustrated, the supporting linkage 18 includes an actuator 74 for controlling its position and movement. A bottom end of the actuator 74 is pivotably connected to the inner bracket 32, and an upper end of the actuator 74 is pivotably connected to the upper bar 36. As shown, the actuator 74 can include a hydraulic cylinder. In other examples, the actuator 74 can include, for example but not limited to, a pneumatic cylinder or an electric actuator.

Figure 8:
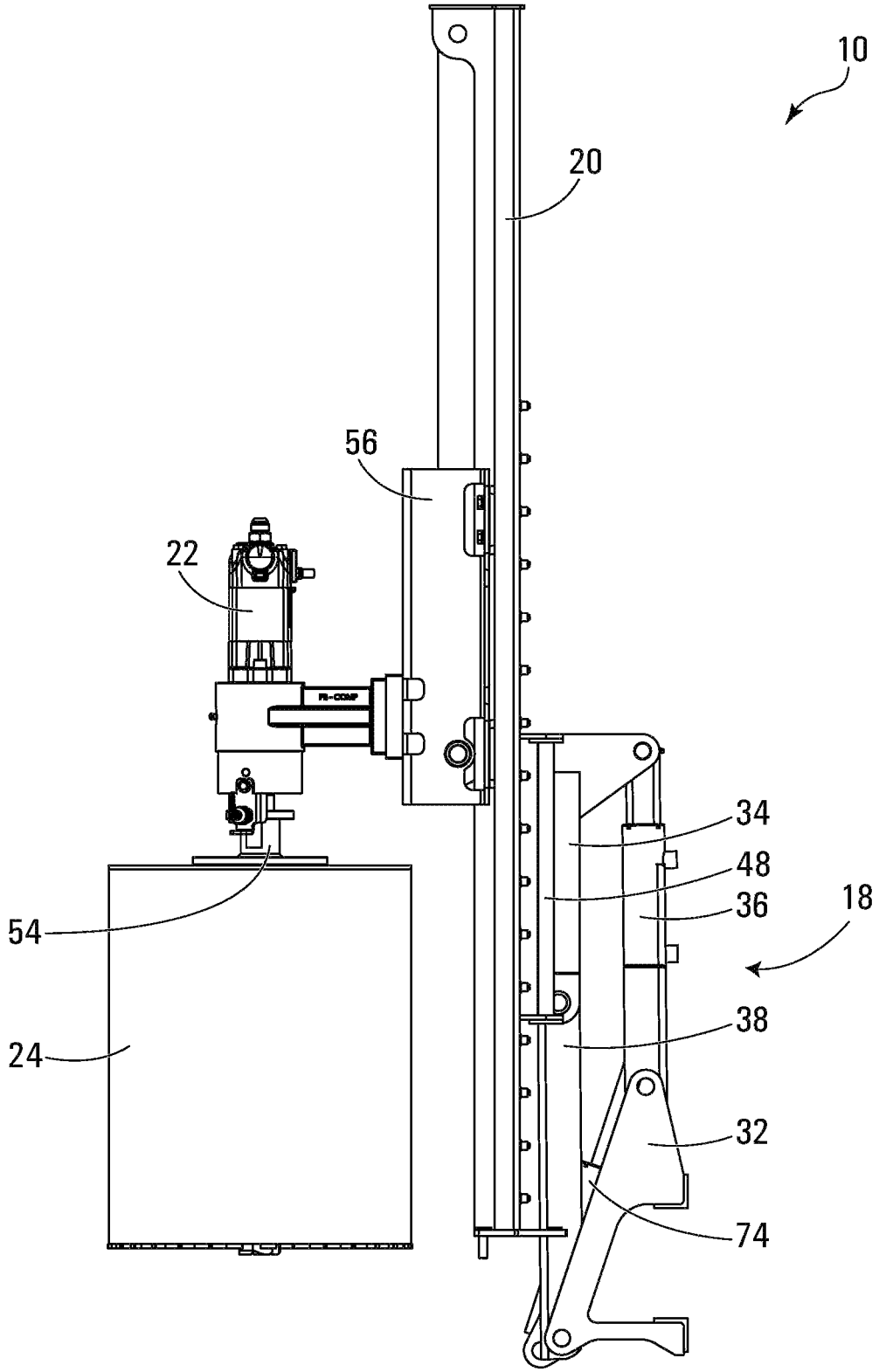
FIG. 8 is a side view of the apparatus in a stored position.

Referring now to FIGS. 4 and 8, extension of the actuator 74 causes the apparatus 10 to move from a deployed position (FIG. 4) to an upright, stored position (FIG. 8). The vertical supporting member 20 and the components mounted thereto are raised upwardly relative to the inner bracket 32 to move to the stored position. In both the deployed and stored positions, the cutting axis 52 can be maintained generally parallel to the vertical direction 30. Retraction of the actuator 74 will cause the apparatus 10 to return from the stored position to the deployed position.

Thus, in the example illustrated, the cutting element 24 and the rotary spindle 54 can be translated with displacement of the supporting linkage 18. Additionally, the cutting element 24 and the rotary spindle 54 can be translated with displacement of the platform 56, independently of displacement of the supporting linkage 18. As described above, leveling of the cutting element 24 can be achieved by actuating the cylinder of the upper bar 36.

The supporting linkage 18 can be operable to securely maintain the vertical supporting member 20 and the components mounted thereto in the stored position. In some examples, the supporting linkage 18 maintains this assembly of components raised so that the cutting element 24 is held at least about 18" above the ground surface.

Figure 9:
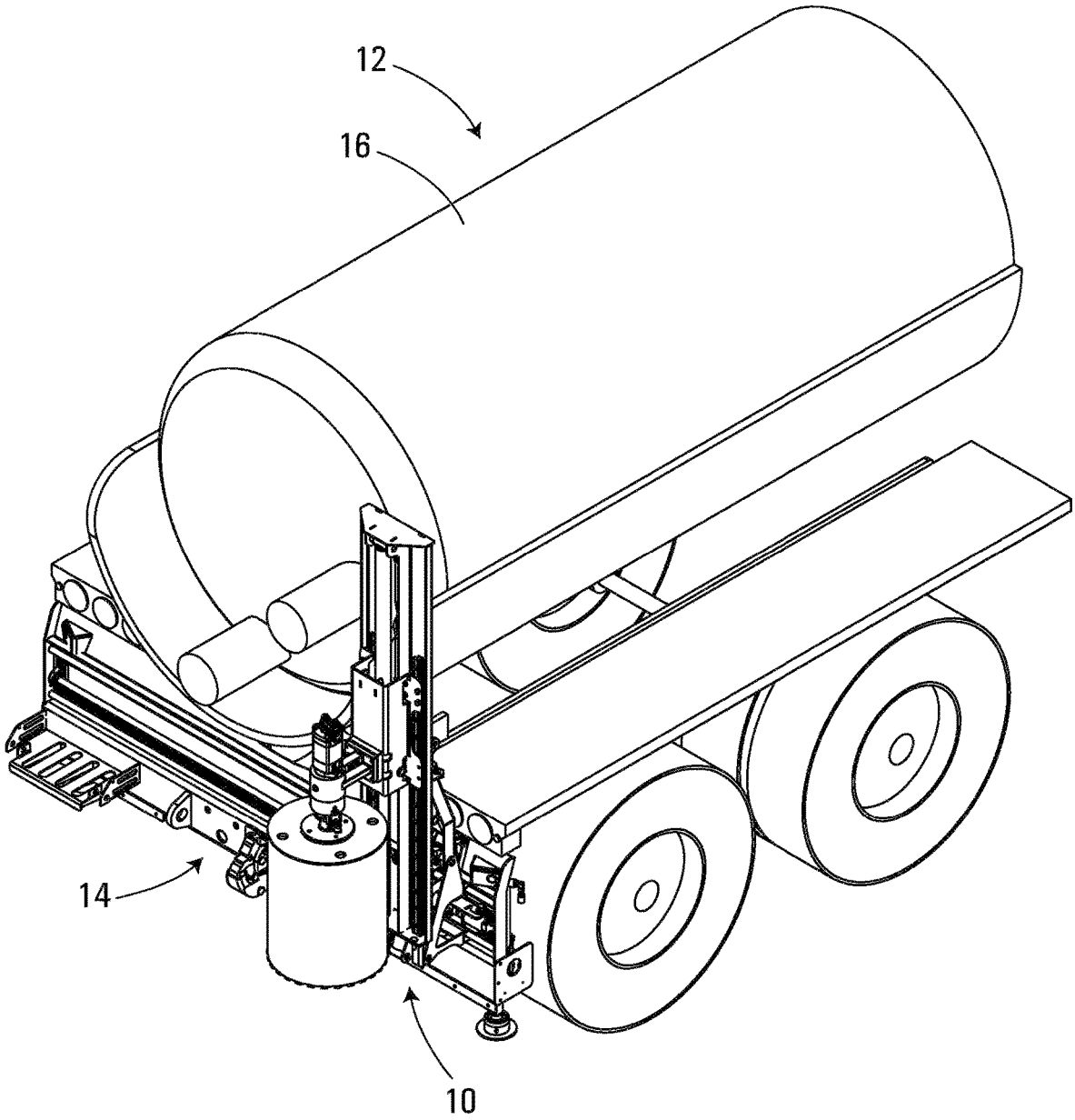
FIGS. 9, 10 and 11 are rear perspective, rear and side views, respectively, of the apparatus and the vehicle, shown with the apparatus in the stored position.
Figure 10:
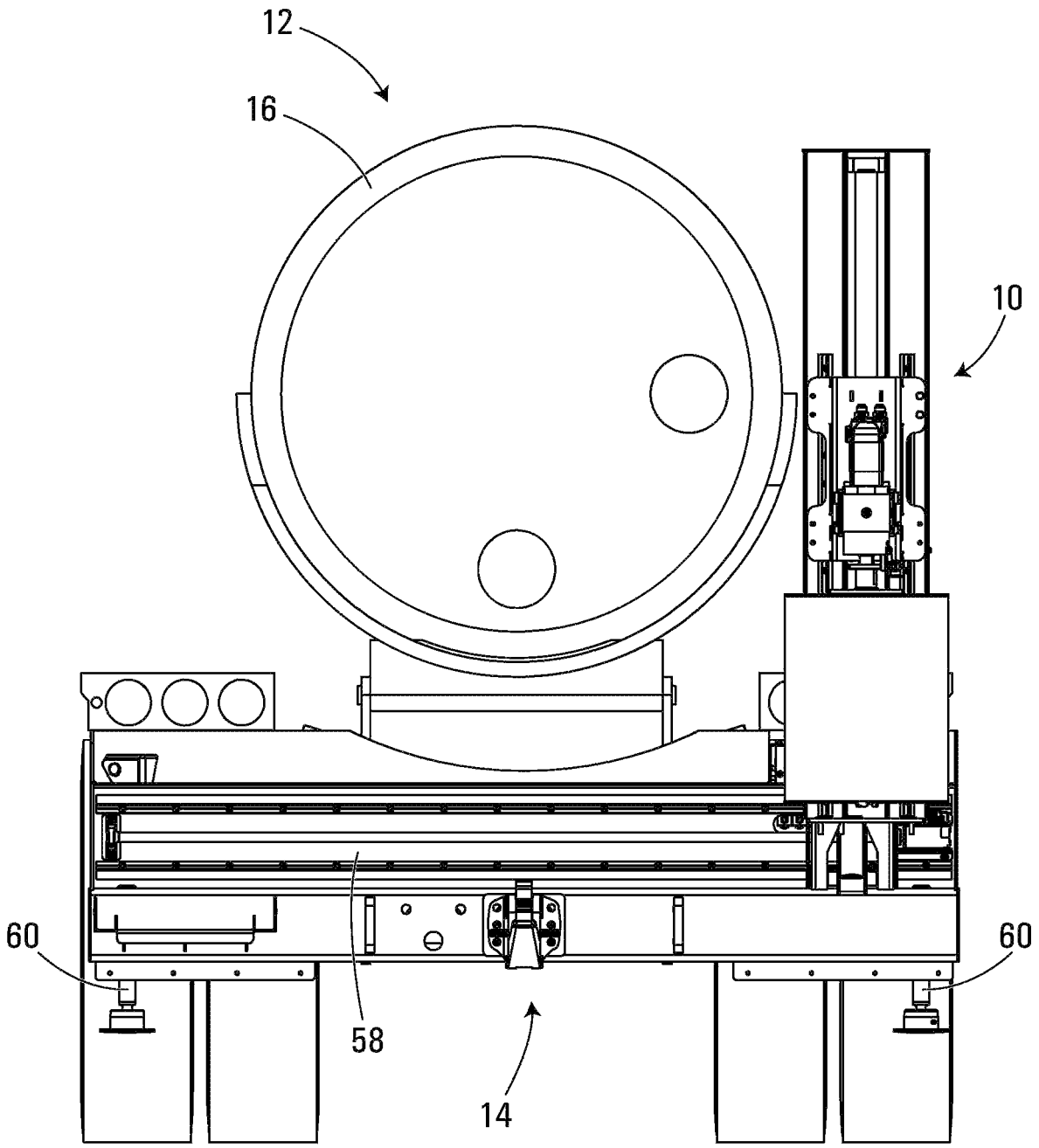
Figure 11:
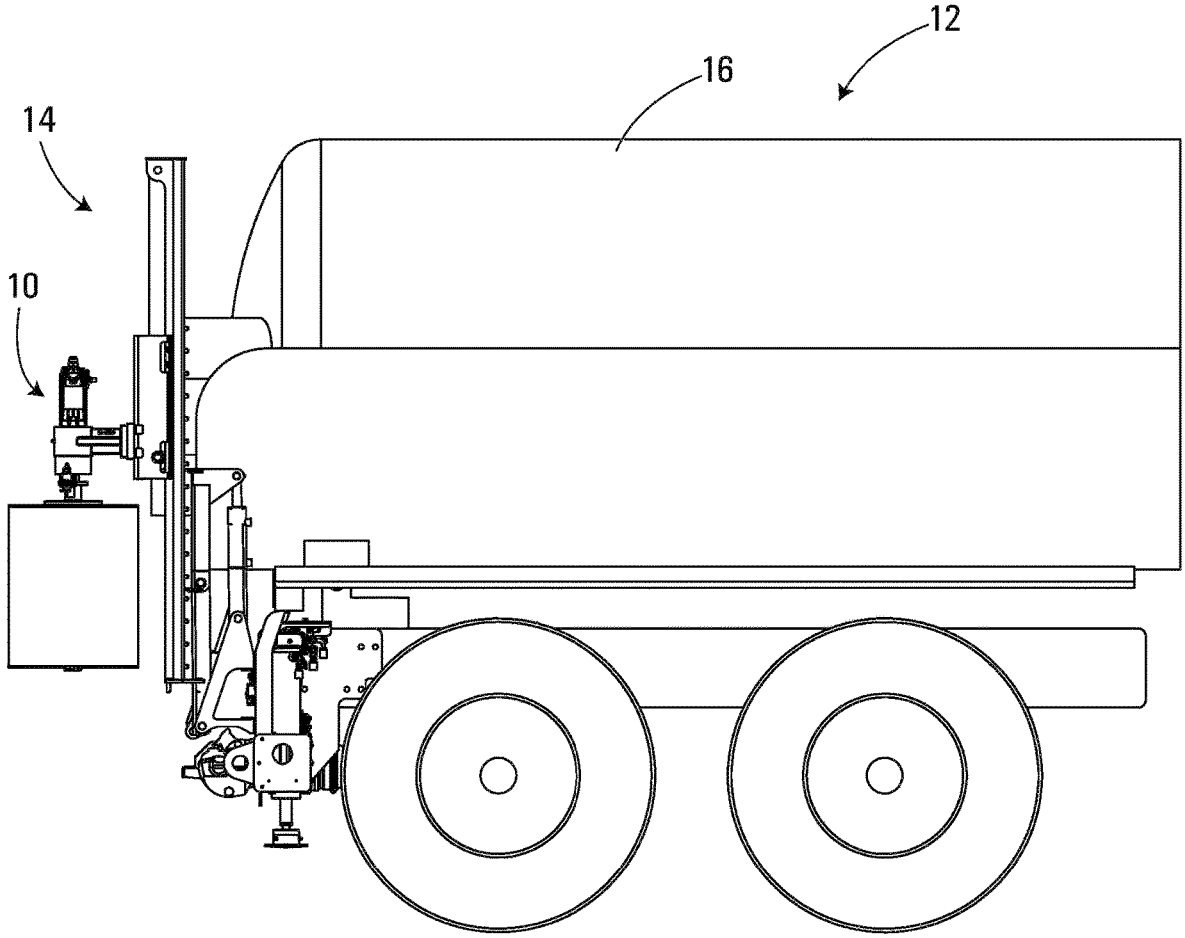

FIGS. 9, 10 and 11 further show the apparatus 10 in the stored position, in combination with the vehicle 12. In the example illustrated, the apparatus 10 is located on the passenger or curb side of the vehicle 12, for safety. The stabilizers 60 are shown in the raised position.

Figure 12:
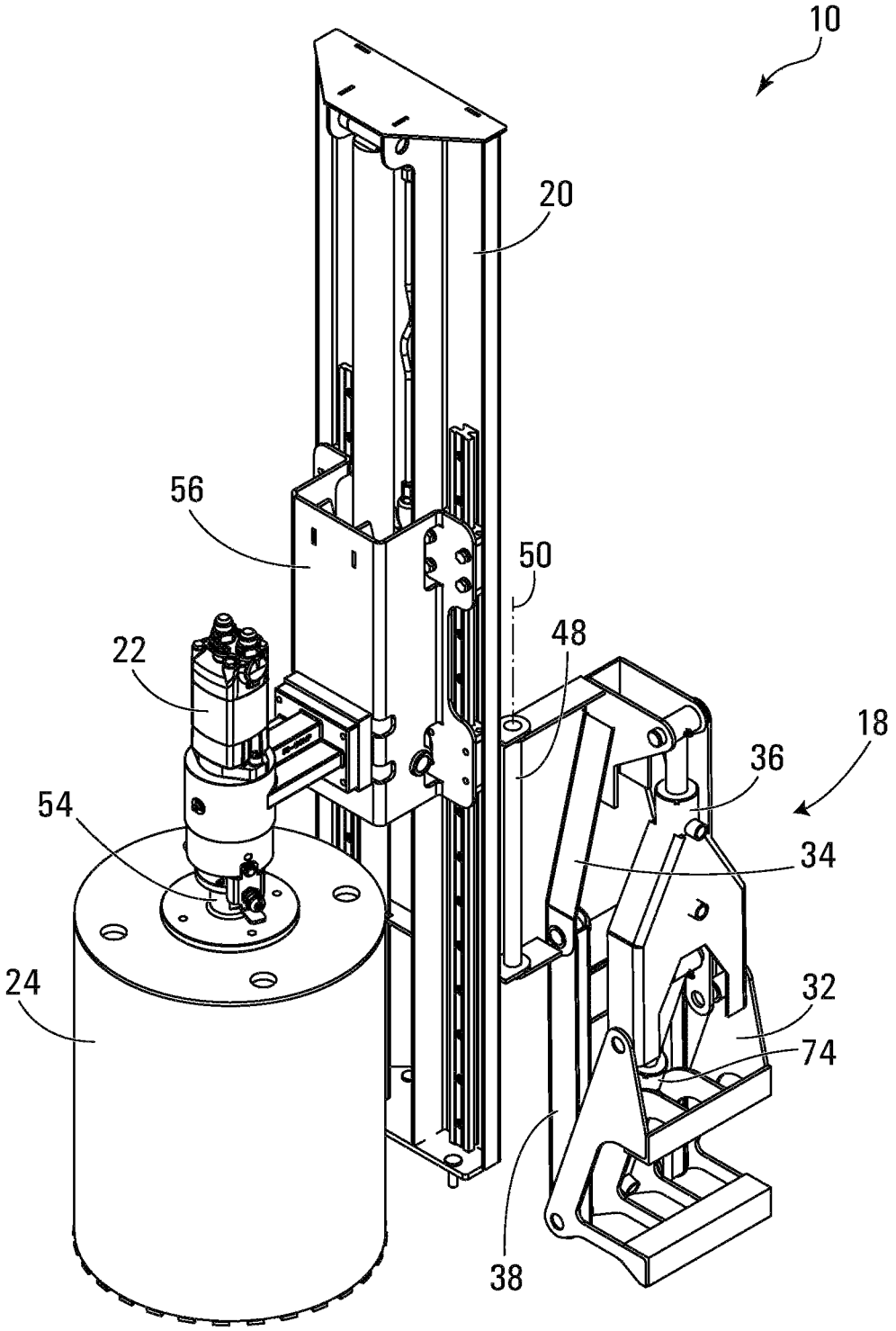
FIGS. 12 and 13 are front perspective and side views, respectively of the apparatus in a cleared position.
Figure 13:
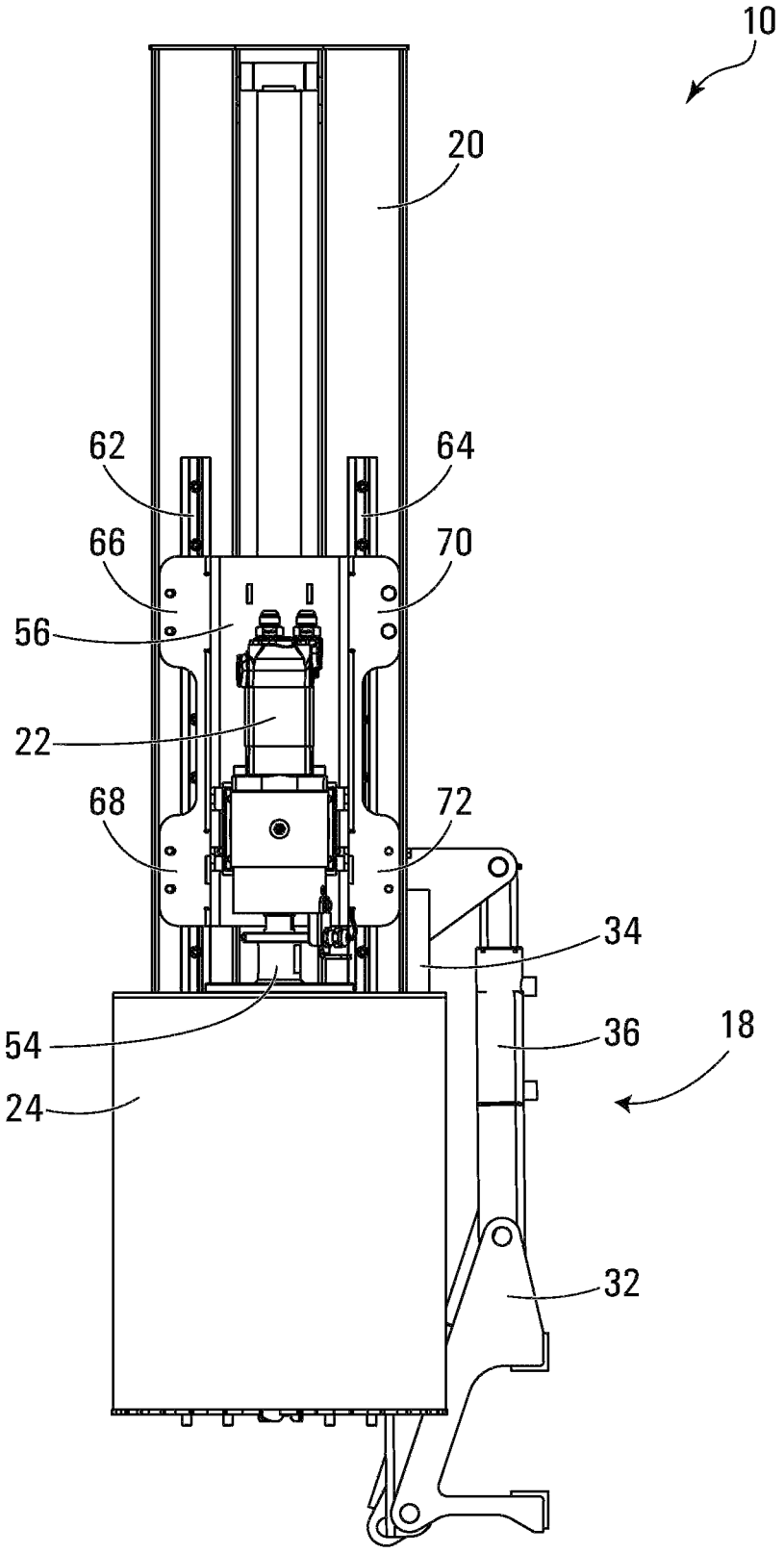
Figure 14:
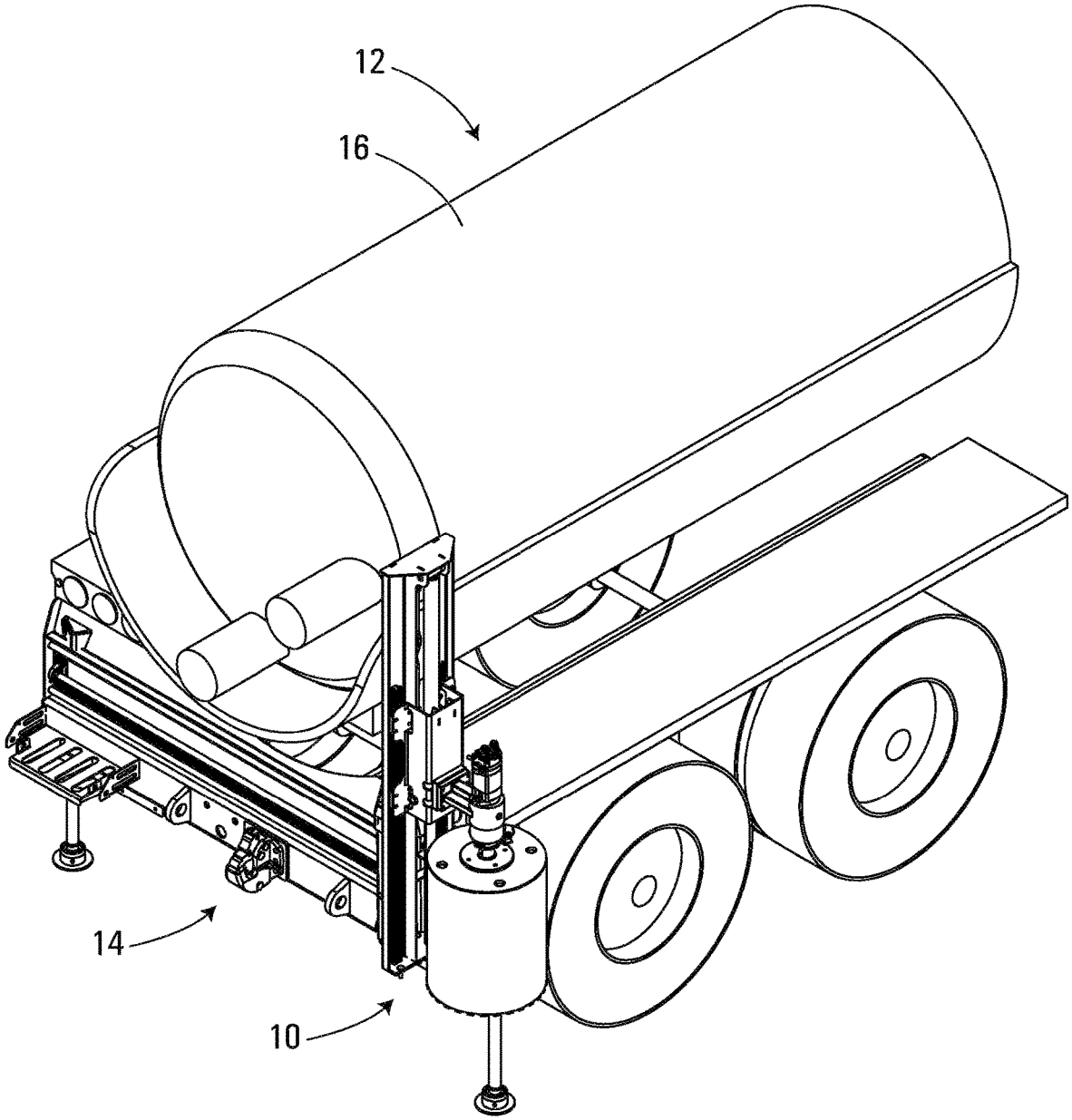
FIGS. 14, 15, 16 and 17 are rear perspective, rear, side and top views, respectively, of the apparatus and the vehicle, shown with the apparatus in the cleared position.

Referring now to FIGS. 12 and 13, the hinge pin 48 allows the vertical supporting member 20 to move about the hinge axis 50 away from the outer bracket 34 to an open or cleared position. In some examples, the apparatus 10 can include an actuator (not shown) that moves the apparatus between the stored and cleared positions. In other examples, the apparatus 10 can be moved manually, by an operator, between the stored and cleared positions. In some examples, the apparatus 10 can include a latch mechanism that securely locks the apparatus 10, either in the stored or cleared positions, or both.

FIG. 13 shows that the vertical supporting member 20 includes linear guide rails 62, 64, and the platform 56 is supported by carriages 66, 68, 70, 72. In the example illustrated, the carriages 66, 68 are slidably coupled to the rail 62 and the carriages 70, 72 are slidably coupled to the rail 64. The vertical supporting member 20 can include a worm gear mechanism or other linear actuator for displacing the platform 56 to provide the vertical range of motion.

It should be appreciated that the apparatus 10 can include various electrical cables, hydraulic/pneumatic lines and other power connections for controlling the motor 22, the stabilizers 60, the actuator of the upper bar 36, the actuator 74, the actuators of the members 20, 58, and/or other components, which have been omitted from the drawings for the sake of clarity.

Figure 15:
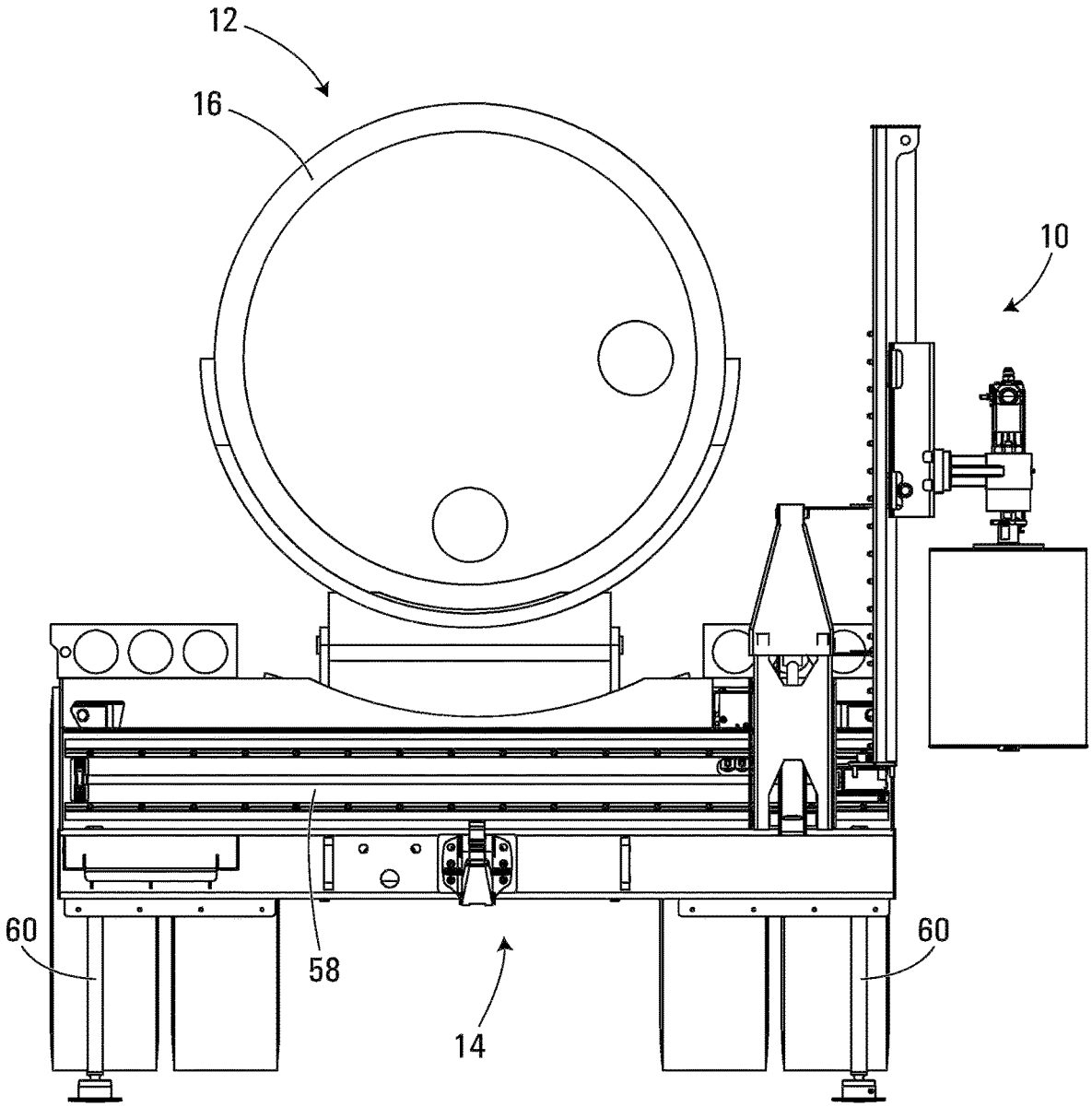
Figure 16:
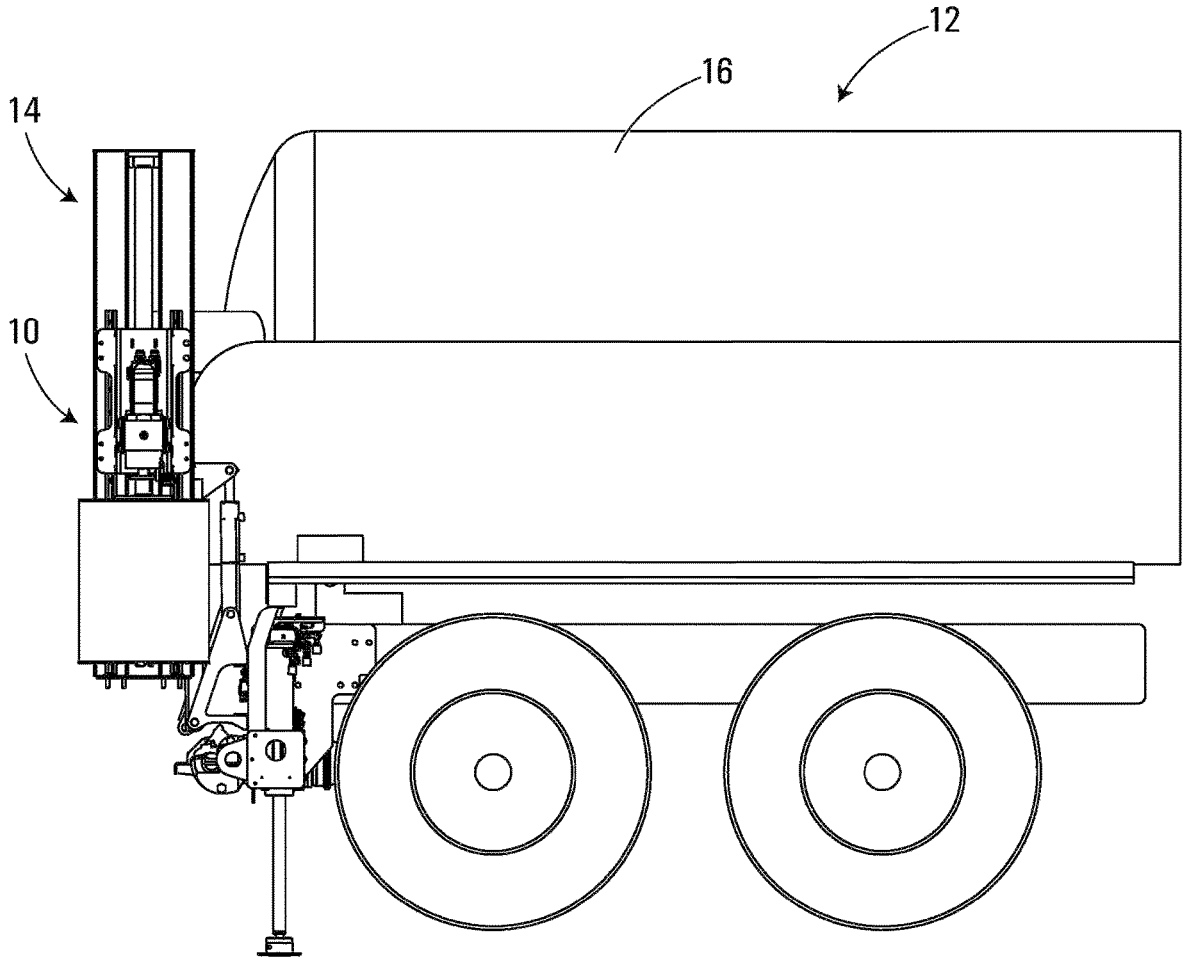
Figure 17:
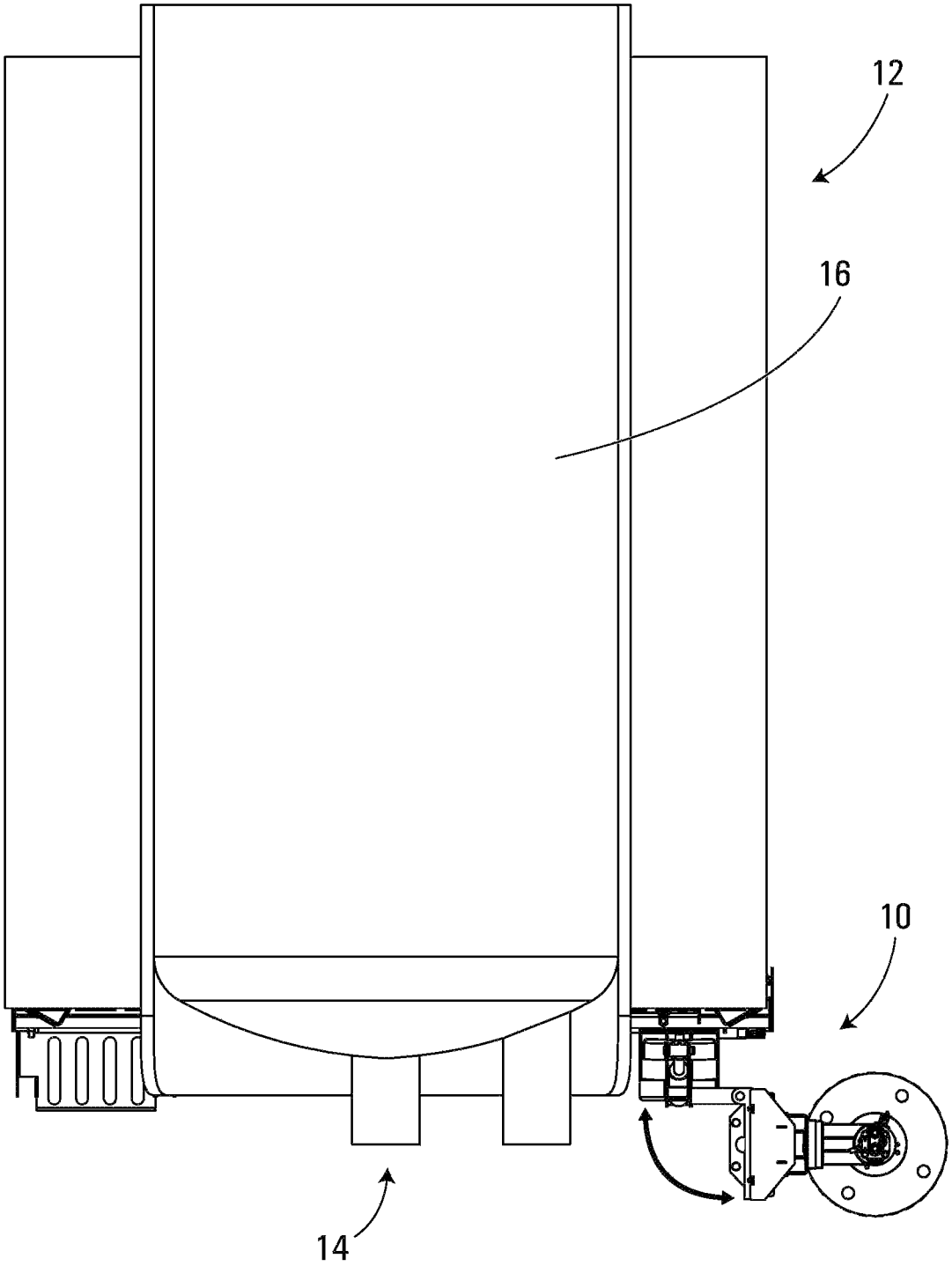

FIGS. 14, 15, 16 and 17 further show the apparatus 10 in the cleared position, in combination with the vehicle 12. As shown in FIG. 15, in the cleared position, the rotary spindle of the apparatus 10 is arranged to exceed the width, or outside of a lateral extent of the rear 14 of the vehicle 12. In the example illustrated, the apparatus 10 is located on the curb side of the vehicle 12, for safety. The stabilizers 60 are shown in the stabilizing position. In some examples, it can be possible for the apparatus 10, while in the deployed position, to be hinged curb side to extend the range of motion for performing a cutting operation.

It should be appreciated that space for any kind of attachment can be limited at the rear of a typical hydro evacuation vehicle, where the vacuum excavation function is located. The way the apparatus 10 is mounted in that limited available space at the rear of the vehicle, including application of the four-bar mechanism 18, enables the unit to be lowered down to core and then elevated back up into the stored position. In the stored position, the apparatus 10 can have a safe vertical road clearance for transit, in a manner that does not interfere with the vacuuming operations, which can be the principal function of the vehicle.

In use, the vehicle 12 with the apparatus 10 in the stored position can be driven into an approximate target position at an excavation site. The stabilizers 60 can be moved to engage the ground in the stabilizing position and securely support the apparatus 10 over the target position. The apparatus 10 can be moved into the deployed position by retraction of the actuator 74. Once in the deployed position, the position of the cutting element 24 can be compared to the target position. The position of the cutting element 24 can be adjusted laterally along the horizontal supporting member 58. The position of the cutting element 24 can be adjusted vertically by displacing the platform 56 up or down. The angle of the cutting axis can be adjusted by actuating the cylinder of the upper bar 36.

Once the cutting element 24 is accurately located and arranged in a desired position above the target, the motor 22 can then be initiated to drive the rotary spindle 54 and the cutting element 24, which can be lowered by displacing the platform 56 downwards. The cutting element 24 can used to cut a cylindrical hole. Once a desired cutting depth is reached, the cutting element 24 can be raised by displacing the platform 56 upwards. Then, the apparatus 10 can be moved back into the stored position by extension of the actuator 74. The vehicle 12 can then be driven to another excavation site.

When it comes time to tip-up and dump the spoils tank 16, the apparatus 10, in the raised stored position, can be swung out of the way of the dump by unlatching the gate-like connection on which it is hinged to swing it out towards the curb side of the vehicle 12 and avoid splash-back from the dump. When the dump is completed, the apparatus 10 can be swung back to its stored position and re-latched.

An advantage of the apparatus of the present disclosure is its ability to combine both coring and vacuuming functions on the same vehicle in a way that does not compromise either function when deployed. It also can eliminate the need for a separate or towed coring unit, or an independent truck mounted coring unit, to cut through the pavement, which can allow the vacuum unit fitted with its own coring attachment to quickly and independently core through the pavement to allow the operator to vacuum excavate to access underground infrastructure buried under concrete or pavement.

While the above description provides examples of one or more apparatuses or methods, it will be appreciated that other apparatuses or methods may be within the scope of the accompanying claims.

We claim:

1. An excavation apparatus, comprising:

a supporting linkage mountable to a vehicle;

a rotary spindle operable to rotatably drive a coring element about a cutting axis; and a hinge pin that couples the supporting linkage to the rotary spindle and permits movement of the rotary spindle relative to the supporting linkage about a hinge axis, wherein the supporting linkage supports the rotary spindle and is operable to displace the rotary spindle in a vertical direction relative to a ground surface, wherein the supporting linkage is configured to lower the rotary spindle in the vertical direction relative to the ground surface to a deployed position, and raise the rotary spindle in the vertical direction relative to the ground surface to a stored position, wherein the supporting linkage comprises an inner bracket, an outer bracket that is spaced apart from the inner bracket, at least one upper bar that is pivotably connected to the inner and outer brackets, and at least one lower bar that is pivotably connected to the inner and outer brackets, wherein the cutting axis is maintained in the vertical direction in the deployed and stored positions, wherein the rotary spindle in the deployed and stored positions is configured to move relative to the supporting linkage about the hinge axis away from the outer bracket to a cleared position, and wherein the hinge axis is generally parallel to the vertical direction.

2. The apparatus of claim 1, wherein the hinge pin connects an outer bracket of the supporting linkage to a vertical supporting member that is coupled to the rotary spindle.

3. The apparatus of claim 1, comprising a horizontal supporting member for coupling the supporting linkage to the vehicle.

4. The apparatus of claim 3, wherein the supporting linkage is configured to translate along the horizontal supporting member.

5. The apparatus of claim 4, comprising a linear actuator configured to move the supporting linkage relative to the horizontal supporting member.

6. In combination, the apparatus of claim 1 and the vehicle, wherein the supporting linkage is mounted to a rear of the vehicle, and, in the cleared position, the rotary spindle is arranged outside of a lateral extent of the rear of the vehicle.

7. The apparatus of claim 1, wherein the supporting linkage comprises an actuator for moving the supporting linkage between the deployed and stored positions.

8. The apparatus of claim 7, wherein the actuator comprises a bottom end pivotably connected to the inner bracket, and an upper end pivotably connected to the at least one upper bar.

9. The apparatus of claim 8, wherein extension .of the actuator causes the supporting linkage to move from the deployed position to the stored position, and retraction of the actuator causes the supporting linkage to move from the stored position to the deployed position.

10. The apparatus of claim 1, wherein at least one of the upper and lower bars comprises an actuator for adjusting an angle of the cutting axis.

11. The apparatus of claim 1, comprising a vertical supporting member that couples the rotary spindle to the supporting linkage.

12. The apparatus of claim 11, wherein the rotary spindle is configured to translate along the vertical supporting member.

13. The apparatus of claim 12, comprising a platform slidably coupled to the vertical supporting member, and the rotary spindle is mounted to the platform.

14. The apparatus of claim 13, comprising a motor for driving the rotary spindle, and the motor is mounted to the platform.

15. The apparatus of claim 13, comprising a linear actuator configured to move the platform relative to the vertical supporting member.

16. An excavation apparatus, comprising:

a supporting linkage comprising an inner bracket that extends in a vertical direction, an outer bracket that extends in the vertical direction and is spaced apart from the inner bracket in a longitudinal direction, at least one upper bar that is pivotably connected to the inner and outer brackets by upper, pivot joints, and at least one lower bar that is pivotably connected to the inner and outer brackets by lower pivot joints, the upper and lower pivot joints permitting movement of the upper and lower bars about pivot axes that are generally parallel to a lateral direction;

a vertical supporting member connected to the outer bracket of the supporting linkage;

a rotary spindle coupled to the vertical supporting member and operable to rotatably drive a coring element about a cutting axis; and a hinge pin that connects the outer bracket of the supporting linkage to the vertical supporting member and permits movement of the vertical supporting member relative to the supporting linkage about a hinge axis, wherein the inner bracket of the supporting linkage is mountable to a vehicle, wherein the lateral direction, the longitudinal direction and the vertical direction are mutually orthogonal, wherein the supporting linkage is configured to lower the vertical supporting member in the vertical direction relative to a ground surface to a deployed position, and raise the vertical supporting member in the vertical direction relative to the ground surface to a stored position, wherein the cutting axis is maintained in the vertical direction in the deployed and stored positions, wherein the vertical supporting member in the deployed and stored positions is configured to move relative to the supporting linkage about the hinge axis away from the outer bracket to a cleared position, and wherein the hinge axis is generally parallel to the vertical direction.

* * * * *